US007605807B2

(12) United States Patent
Chen et al.

(10) Patent No.: US 7,605,807 B2
(45) Date of Patent: Oct. 20, 2009

(54) CONTROL CIRCUIT FOR BALANCING CURRENT AND METHOD THEREOF

(75) Inventors: Pei-Ting Chen, Chunan (TW); Chih-Tsan Huang, Chunan (TW); Tzu-Shou Kuo, Hsinchu (TW)

(73) Assignees: Coretronic Corporation, Miaoli County (TW); Young Lighting Technology Corporation, Hsinchu (TW)

( * ) Notice: Subject to any disclaimer, the term of this patent is extended or adjusted under 35 U.S.C. 154(b) by 627 days.

(21) Appl. No.: 11/395,233

(22) Filed: Apr. 3, 2006

(65) Prior Publication Data

US 2006/0238466 A1 Oct. 26, 2006

(30) Foreign Application Priority Data

Apr. 26, 2005 (TW) ..... 94113276 A

(51) Int. Cl.
*G09G 3/30* (2006.01)

(52) U.S. Cl. ..... 345/204; 345/39; 345/52; 345/63; 345/77; 345/214

(58) Field of Classification Search ..... 345/30, 345/39, 52, 63, 77, 82, 204, 214, 690
See application file for complete search history.

(56) References Cited

U.S. PATENT DOCUMENTS 4,329,625 A * 5/1982 Nishizawa et al. ..... 315/158
5,436,710 A * 7/1995 Uchiyama ..... 399/336
6,641,294 B2 * 11/2003 Lefebvre ..... 362/544
6,683,421 B1 * 1/2004 Kennedy et al. ..... 315/291
6,894,663 B1 * 5/2005 Altman ..... 345/31
7,460,351 B2 * 12/2008 Wei et al. ..... 361/103
2004/0001039 A1 * 1/2004 Shino et al. ..... 345/100
2005/0001537 A1 * 1/2005 West et al. ..... 313/500
2005/0093488 A1 * 5/2005 Hung et al. ..... 315/307
2005/0140610 A1 * 6/2005 Smith et al. ..... 345/77
2005/0217457 A1 * 10/2005 Yamamoto et al. ..... 84/464 R

* cited by examiner

*Primary Examiner*—Bipin Shalwala
*Assistant Examiner*—Vince E Kovalick
(74) *Attorney, Agent, or Firm*—Rosenberg, Klein & Lee

(57) ABSTRACT

A control circuit for balancing current in a thin display device includes a light source, a power supply, and a control part. The light source includes a plurality of parallel light-emitting diode (LED) rows. The LED row includes at least one LED and a switch unit. The switch unit is in series connection with the LED. The switch unit has two working conditions, one is on and the other is off, to determine whether the current passes through the LED row. The power supply provides a working power for the LEDs. The control part detects the currents of the LED rows, controls the on-state timing ratio of the switch unit and controls the output power of the power supply.

9 Claims, 6 Drawing Sheets

CONTROL CIRCUIT FOR BALANCING CURRENT AND METHOD THEREOF

RELATED APPLICATIONS

The present application is based on, and claims priority from, Taiwan Application Serial Number 94113276, filed Apr. 26, 2005, the disclosure of which is hereby incorporated by reference herein in its entirety.

FIELD OF THE INVENTION

The present invention relates to a control circuit for balancing current, and more particularly, to a control circuit for balancing current of the light emitting diode (LED) of the light source in a thin display device.

BACKGROUND OF THE INVENTION

Reference is made to FIG. 1, a light source is formed by a plurality of LED rows 010' in parallel connection with each other in a conventional thin display device, in which the respective LED rows 010' include at least one LED 001' and an adjusting device 002'. In order to make the thin display device to have uniform brightness on the screen, the conventional adjusting method usually adjusts the currents of the respective LED rows 010' to be the same. The adjusting device 002' adjusts an impedance value to make the respective LED rows 010' to be the same, for achieving the state of current balance.

However, in such adjusting method, the adjusting device 002' in series connection with the respective LED row 010' consumes more power, and the total efficiency of the light source 100' is relatively affected, too. Moreover, the impedance value adjusted by the adjusting device 002' is the default set in the production, and the default is different to be adjusted after assembling. The change of the impedance value depends on the influence of external factors, such as temperature and humidity thereby affecting the current balance of the respective LED rows 010'.

In addition, in order to match a rapid change of an image for the thin display device, the light source blinks and turns off transiently in a frequency of persistence of vision of human eyes, for preventing image-sticking phenomenon on the screen. The respective LED rows 010' in the conventional light source 100' are directly connected with the power supply 200'. An output capacitance usually exists in the power supply 200'. After the power is cut off, the power is continuously provided until the output capacitance finishes discharging. It results that the light source 100' fades away to decrease luminance gradually when the light source 100' is turned off. Consequently, light source 100' causes image-sticking phenomenon on the screen.

Moreover, the respective LED rows comprise a plurality of LEDs 001' in series connection. If any LED 001' of the LED row 010' is broken to form an open circuit, such LED row 010' cannot work.

SUMMARY OF THE INVENTION

It is an aspect of the present invention to provide a control circuit for balancing current, which controls the current balance of the respective LED row of the light source in a thin display device anytime and continuously.

It is another aspect of the present invention to provide a control circuit for balancing current, which enables the LED to blink and turn off transiently for preventing image-sticking phenomenon on the screen.

It is a further aspect of the present invention to provide a control circuit for balancing current, even though one of the LEDs is broken which enables the other LEDs operating normally and continuously, and simultaneously controls the current balance of the respective LED row.

According to the aforementioned aspect of the present invention, a control circuit for balancing current is provided, which is employed in a thin display device. The control circuit for balancing current comprises a light source, a power supply and a control part. The light source includes a plurality of parallel LED rows, wherein each of the LED rows includes at least one LED and a first switch unit. The first switch unit is in series connection with the LED, for determining whether a current passes through each of the LED rows according to on/off two states. The power supply provides the LEDs with a working power. The control part detects the current of the LED rows, controls an on-state timing ratio of the first switch units, and controls an output power of the power supply.

In a preferred embodiment of the present invention, the each of LED rows further includes a current-limiting device in series connection with the LED and the first switch unit, for limiting the current of each of the LED rows.

In a preferred embodiment of the present invention, the control circuit for balancing current further comprises a short circuit connected in parallel with the LED for connecting two ends of an open circuit caused by a broken LED. The short circuit comprises a trigger part and a second switch unit. The trigger part detects the open circuit caused by the broken LED, and then triggers the second switch unit to be at an on-state for connecting the two ends of the open circuit. The short circuit further comprises a safety device in series connection with the trigger part. The safety device includes a wave-filtering part and a current-limiting part. The wave-filtering part is employed to filter a noise signal passed through the trigger part for preventing a mistaken operation of the trigger part. The current-limiting part connects in parallel with the wave-filtering part, and the current-limiting part is employed to limit the current passed through the trigger part.

In a preferred embodiment of the present invention, the control part generates a reference timing pulse for control the on-state timing ratios of the first switch units according to the reference timing pulse.

According to the aforementioned aspect of the present invention, a controlling method for balancing current is further provided, which is employed to balance currents of a plurality of parallel LED rows in a thin display device. At first, a current of anyone of the LED rows is increased to a predetermined working current. Next, a minimum current of the currents of the LED rows is selected. And then, the minimum current is increased to the predetermined working current. Afterwards, an on-state timing ratio of a current of each of the LED rows is counted, and the currents of the LED rows change according to the on-state timing ratio.

In a preferred embodiment of the present invention, the controlling method for balancing current further comprises cutting off a power supply when the current of anyone of the LED rows is detected to be zero.

In a preferred embodiment of the present invention, the controlling method for balancing current further comprises connecting an open circuit caused by a broken LED of the LED rows.

In a preferred embodiment of the present invention, the controlling method for balancing current further comprises making the LED rows to be opened when the current of anyone of the LED rows is detected to be increased abnormally. Afterwards, detection of the current of the LED rows is skipped or a power supply is cut off.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Hereinafter, the spirit of the present invention is more explicitly and completely clarified with reference to the following figures. After the preferred embodiments of the present invention is understood by a person skilled in the art, various modifications and similar arrangements can be made according to the skill taught by the present invention and be included within the spirit and scope of the present invention.

Figure 1:
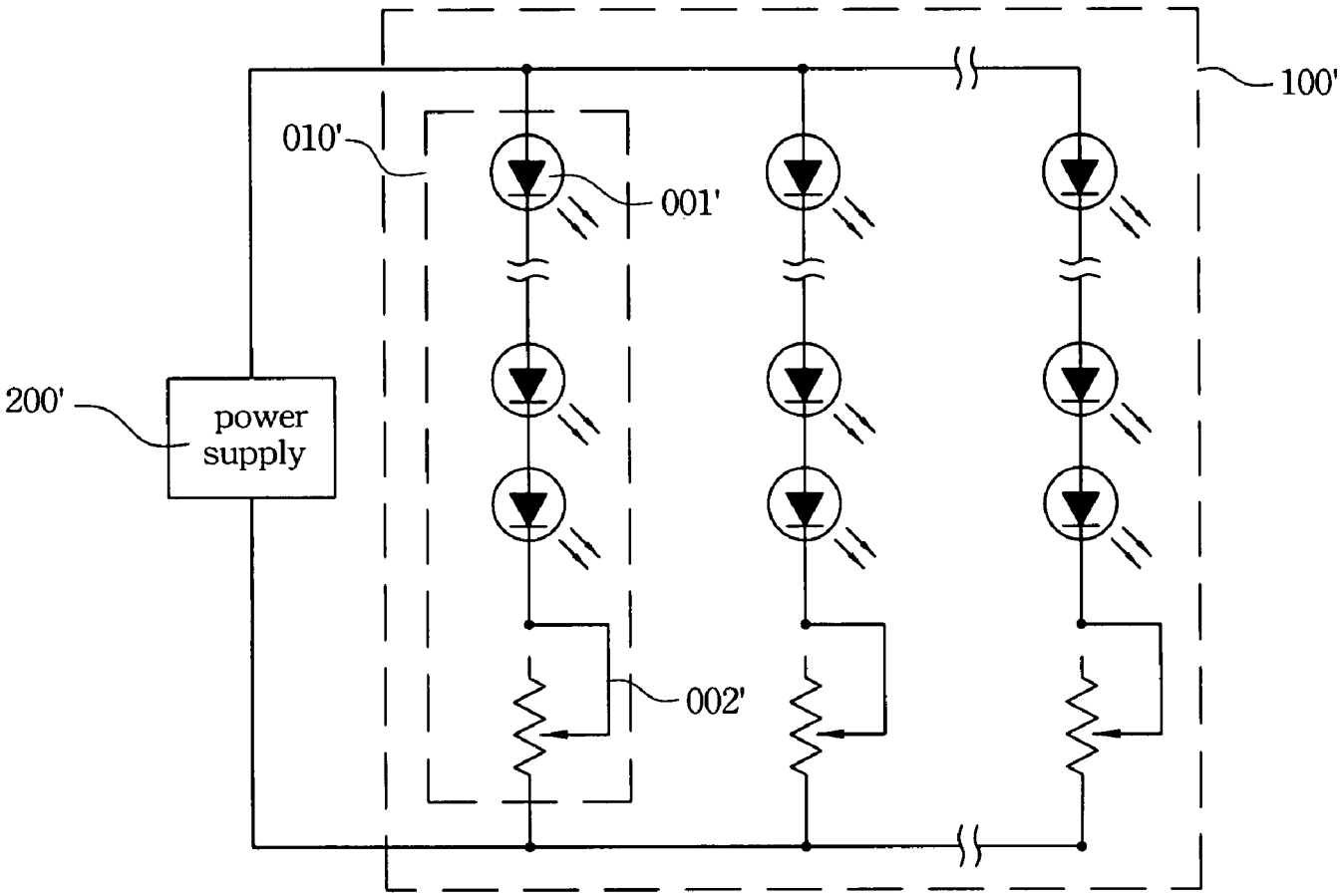
FIG. 1 (Prior Art)
FIG. 1 depicts a diagram of the control circuit for balancing current in the prior art.
Figure 2:
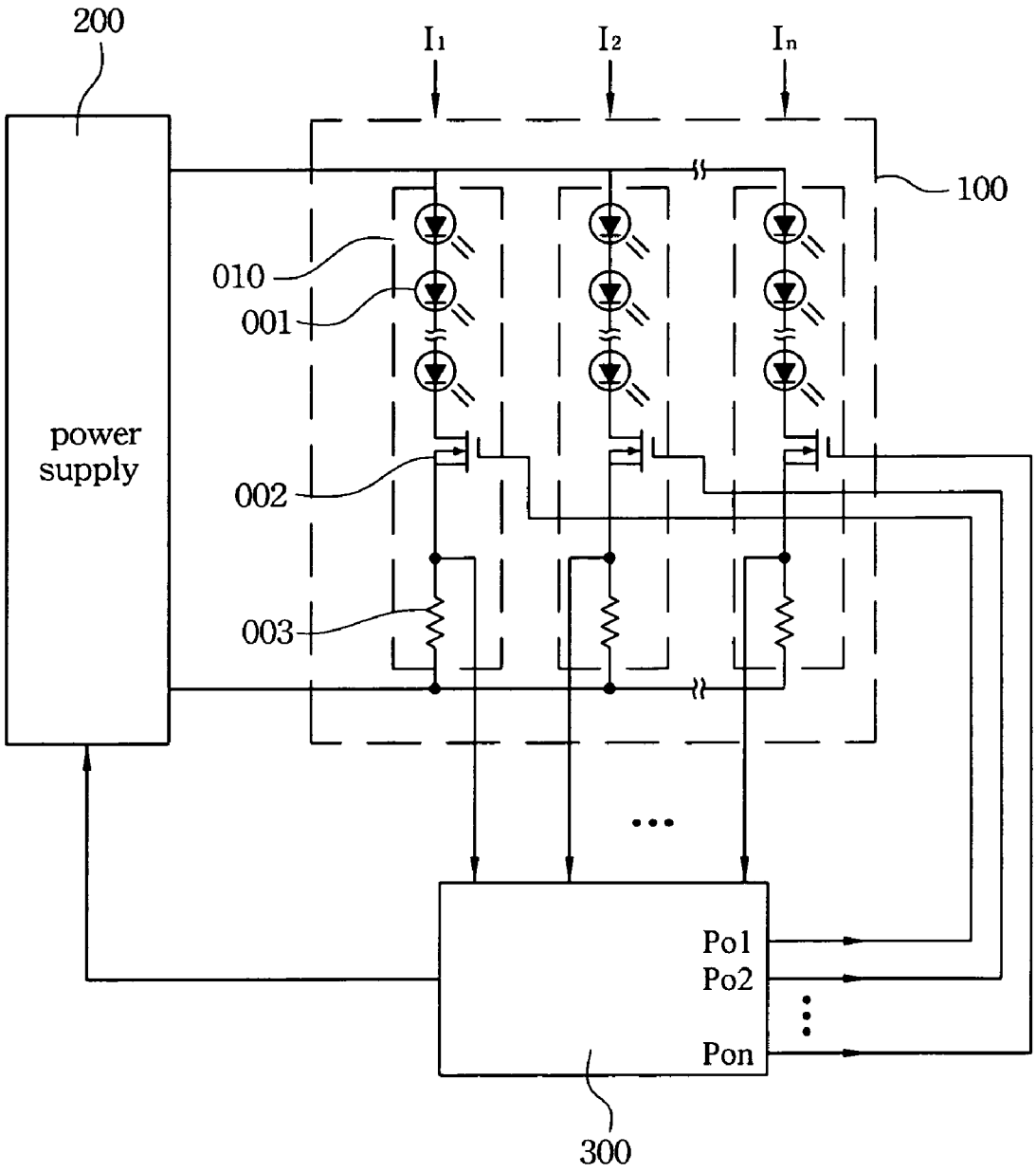
FIG. 2 depicts a diagram of the control circuit for balancing current of the present invention.

Reference is made to FIG. 2, the control circuit for balancing current of the present invention is employed to adjust the current balance of the respective LED row of a light source in a thin display device. The control circuit for balancing current comprises a light source 100, a power supply 200 and a control part 300.

The light source 100 includes a plurality of parallel LED rows 010, wherein each of the LED rows 010 comprises at least one LED 001 and a first switch unit 002. The LED 001 is in series connection with the switch unit 002. The LED 001 is employed to irradiate and illuminate, and the switch unit 002 is employed to determine whether a current passes through each of the LED rows 010 according to on/off two states, that is to say, to determine whether the LED 001 is turned on/off. The switch unit 002 is a device of, for example, a semiconductor transistor, a metal-oxide semiconductor field-effect transistor (MOSFET) and the like.

The power supply 200 is in series connection with the light source 100 for providing the respective LED 001 with a working power.

The control part 300 receives currents $I_1$ to $I_n$, of the respective LED row 010, detects whether the currents $I_1$ to $I_n$ are the same, controls an on-state timing ratio of the switch units 002 on the basis of the currents $I_1$ to $I_n$, and controls an output power of the power supply 200.

The LED rows 010 further includes at least one current-limiting device 003, which is in series connection with the LED 001 and the switch unit 002 for limiting the current of each of the LED rows 010. The current-limiting device 003 is, for example, a resistor.

Figure 3:
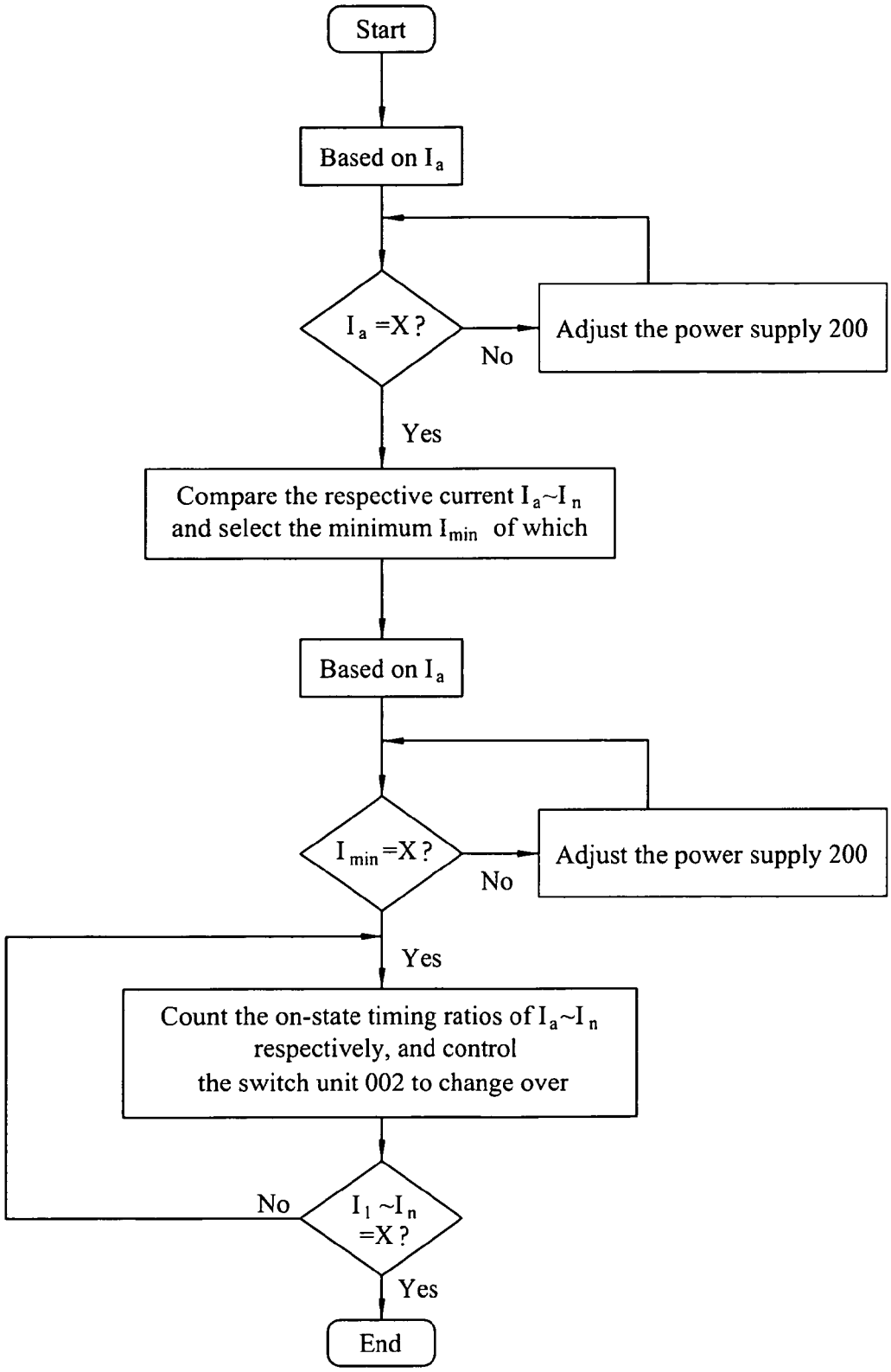
FIG. 3 depicts an operation flow chart of the present invention.

Please refer to FIGS. 2, 3, and, 4. The control circuit for balancing current of the present invention corresponds to the current value of the respective LED row 010. The control part 300 is employed to control an on-state timing ratio of the switch unit 002 of the respective LED row 010, thereby converting the current passed through the respective LED row 010 into pulses having appropriate on-state timing ratio. The current of the respective LED row 010 is adjusted to perform a light modulation of pulse width modulation (PWM).

At first, a working current value X of each LED rows 010 and a blinking frequency TL of each LED 001 are predetermined. The blinking frequency TL is higher than a frequency of persistence of vision of human eyes.

The control part 300 controls the switch unit 002 to quickly convert the current passed through each LED rows 010 into a power source as the frequency TL.

Based on the current $I_a$ of one LED row 010, the power supply 200 controlled by the control part 300 outputs a power source to make $I_a$ to achieve the predetermined working current value X.

The currents $I_1$ to $I_n$ are compared with each other, and the minimum $I_{min}$ of which is found out.

Based on the minimum $I_{min}$, the power supply 200 controlled by the control part 300 outputs another power source for promoting the minimum $I_{min}$ to the predetermined working current value X.

When the original minimum $I_{min}$ is increased to the predetermined working current value X, currents of other LED rows are increased to be more than the working current value X because of the raised power source.

At this time, the on-state timing ratio of the switch unit 002 of the respective LED row 010, i.e. the ratio of X to the respective current $I_1$ to $I_n$ is counted. The switch unit 002 in series connection with the respective LED row 010 is controlled by the control part 300, and the switch unit 002 converts the current of the respective LED row 010 into the pulses having appropriate on-state timing ratio.

The control part 300 receives the currents $I_1$ to $I_n$ anytime and continuously, detects whether the currents $I_1$ to $I_n$ are the same, controls an on-state timing ratio of the respective switch units 002 on the basis of the currents $I_1$ to $I_n$, and controls an output power of the power supply 200 for maintaining the balance of the currents $I_1$ to $I_n$.

In addition, as any broken LED 001 causes an open circuit, no current passes through such LED row 010 and the current value is zero. As the control part 300 detects that the current of any LED row 010 is zero, the control part 300 sends a signal to cut off power supplying of the power supply 200. It prevents severer damage caused by the abnormal current values of other LED rows 010 that results from the control part 300 setting the current value of the open-circuited LED row 010 as the minimum $I_{min}$ to raise power supplying of the power supply 200 unlimitedly.

Besides, when the current of the LED row 010 is abnormally higher than the predetermined working current value X, at this time, the control part 300 controls the switch unit 002 to cut off for forming an open circuit, so that it prevents the abnormally high current from destroying the control part 300. While the switch unit 002 is cutting off for forming an open circuit, the current value of the LED row 010 is zero. In order to prevent severer damage caused by the abnormal current values of other LED rows 010 that results from the control part 300 setting the current value of the open-circuited LED row 010 as the minimum $I_{min}$ to raise power supplying of the power supply 200 unlimitedly, in the meantime that the switch unit 002 cuts off for forming the open circuit, the control part 300 sends a signal to skip the detection of the current of the LED row 010 and to continue the normal operation of other LED rows 010. Alternatively, the control part 300 sends a signal to cut off power supplying of the power supply 200.

Figure 4:
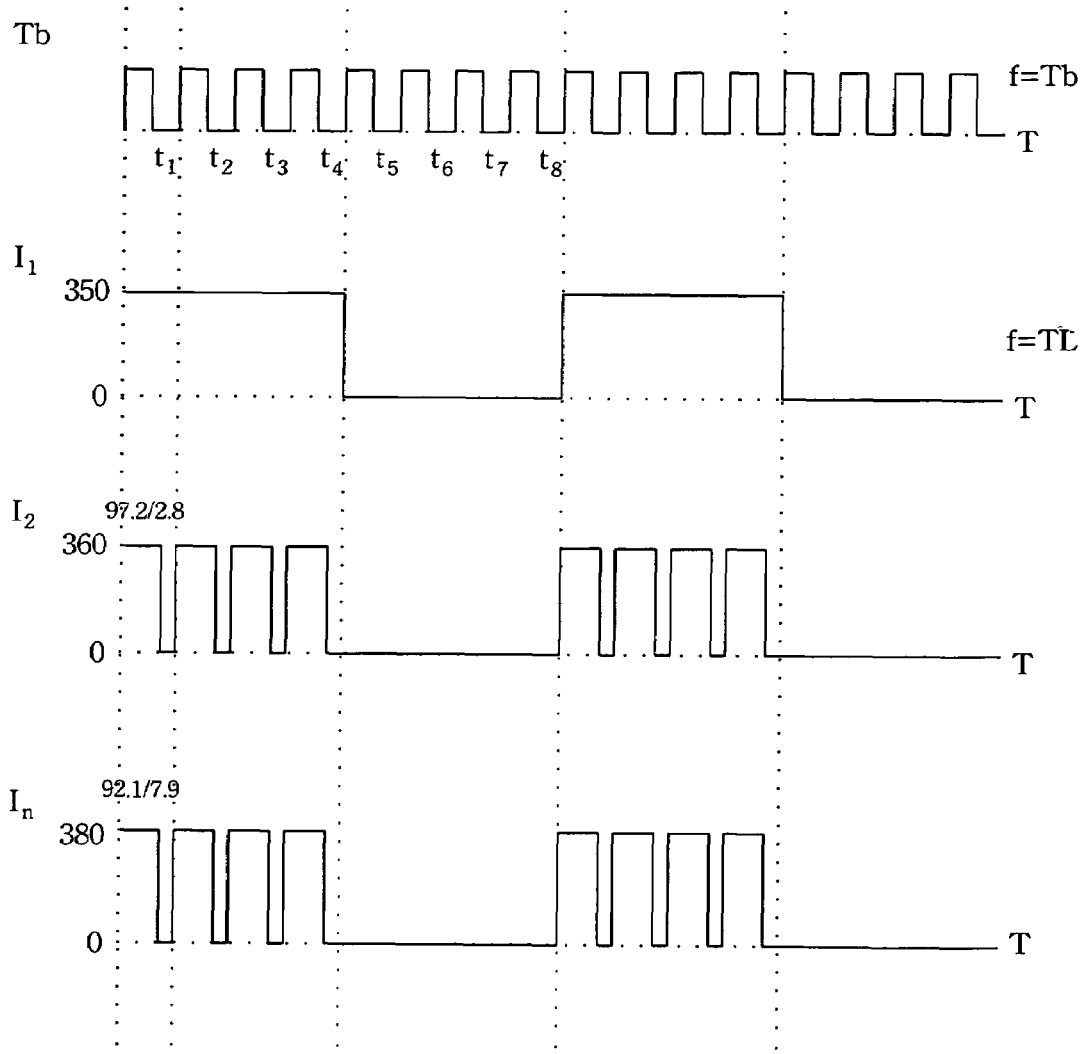
FIG. 4 depicts a timing diagram.

Reference is made to FIG. 4, if the predetermined working current value X is 350 mA and the blinking frequency of the LED is TL, the control part 300 generates a reference timing pulse Tb. If the current $I_1$ is 350 mA, the current $I_2$ is 360 mA, and the current $I_n$ is 380 mA, relative to the reference timing pulse Tb, the control part 200 controls the switch unit 002 of the LED row 010 of the current $I_1$ according to the frequency TL, so the current $I_1$ is kept as a pulse of 350 mA and the frequency TL.

The ratio of the predetermined working current value X to the current $\mathbf{1}_2$, i.e. 360 divided by 380, is approximately 97.2 percent. Therefore, when the current $I_2$ of the frequency TL is in the Hi condition, relative to the reference timing pulse Tb, the control part 200 further controls the switch unit 002 of the LED row 010 of the current $I_2$ to convert according to 97.2 percent of the on-state timing ratio, so the current $I_2$ at the frequency TL in the Hi condition is converted into a pulse of 97.2 percent of the on-state timing ratio.

In the same way, the ratio of the predetermined working current value X to the current $I_n$, i.e. 350 divided by 380, is approximately 92.1 percent. Therefore, when the current $I_n$ of the frequency TL is in the Hi condition, relative to the reference timing pulse Tb, the control part 200 further controls the switch unit 002 of the LED row 010 of the current $I_n$ to convert according to 92.1 percent of the on-state timing ratio, so the current $I_n$ at the frequency TL in the Hi condition is converted into a pulse of 92.1 percent of the on-state timing ratio.

Accordingly, the currents $I_2$ and $I_n$ are controlled to be the same as the predetermined working current value X.

As the current of the respective LED row is in the condition that the pulse is zero, it means that the control part 200 controls the switch unit 002 to be in a cut-off and opened-circuit state. The power supply 200 cannot supply power to the respective LED row 010, at this time, the respective LED is turned off.

The operation of balancing currents proceeds anytime and continuously. Hence, when some external factors, such as temperature, humidity and the like, cause the circuit resistance to change, the currents of the circuit are also adjusted anytime and continuously.

Because the respective LED 001 and the respective current-limiting device 003 utilize the same settings, the difference between the above two is much less. Moreover, the blinking frequency TL for controlling the respective LED 001 is further higher than the frequency of persistence of vision of human eye, and the converted pulses of appropriate on-state timing ratio according to the reference timing pulse Th is equal to or more than the frequency TL. Thus, human eyes do not feel the light source unevenness or blinks resulted from the different on-state times of the LED rows 010. Instead, the LED rows 010 are controlled at the same current respectively to have the same brightness.

Also, the on/off two states of the switch unit 002 determine whether the current passes through the LED row 010, and no output capacitor exists. After cutting off the switch unit 002, the LED row 010 immediately exhibits an opened state, so that the LED 001 is transiently turning off while the switch unit 002 is cutting off.

Figure 5:
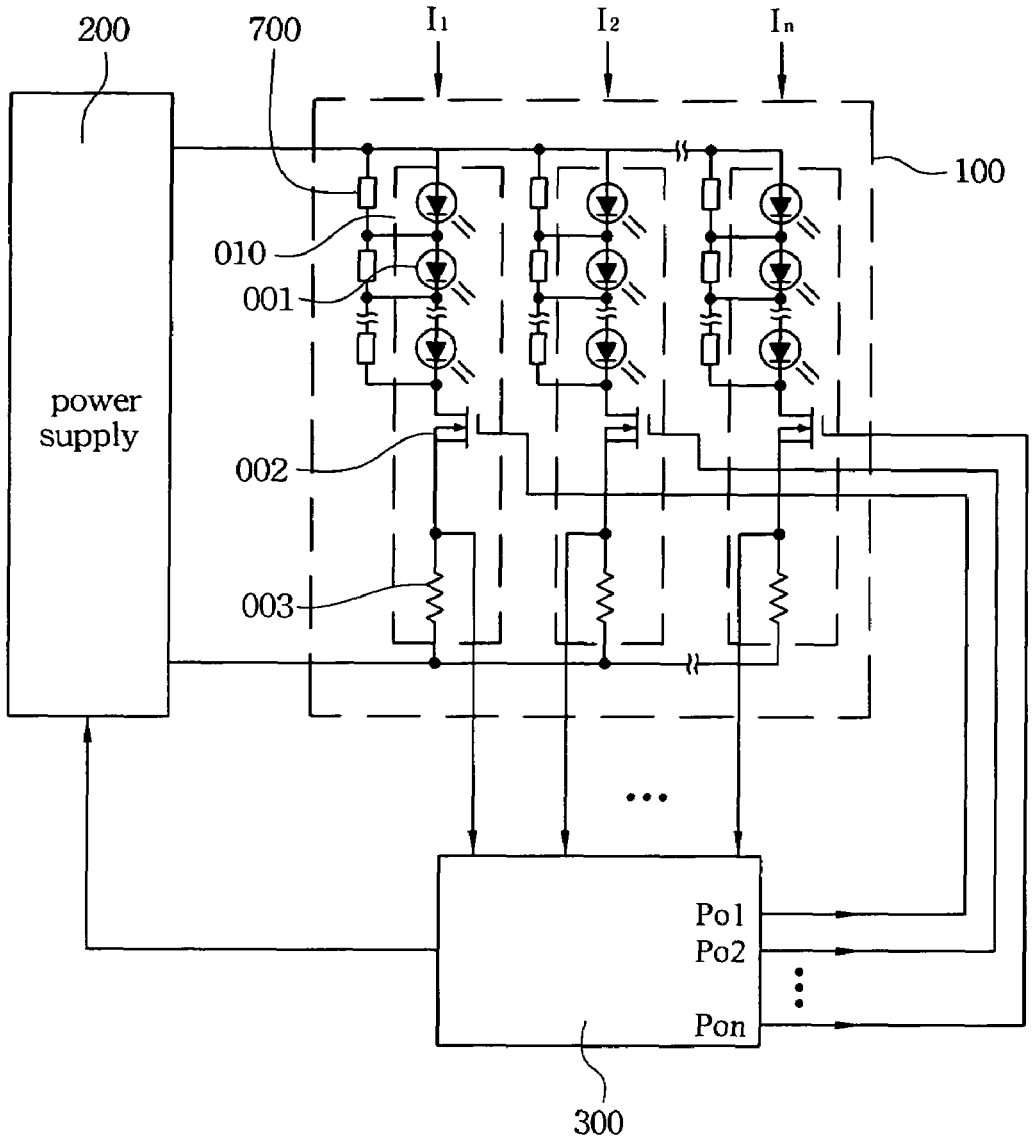
FIG. 5 depicts a circuit diagram of the control circuit for balancing current according to an implemented embodiment.

Various applications and practices can be carried out within the scope of the technical thought of the present invention. Reference is made to FIG. 5, which is a circuit for balancing currents including a plurality of short circuits 700. The short circuits 700 are connected in parallel with the respective LEDs 001 for connecting two ends of an open circuit caused by a broken LED, so that other unbroken LEDs 001 of the same LED row 010 can continue to operate. When the short circuit 700 operates, the change of the current depends on the change of the impedance value of the LED row 010. At this time, the above method for balancing current is repeated to adjusted the current to the predetermined working current value X.

Figure 6:
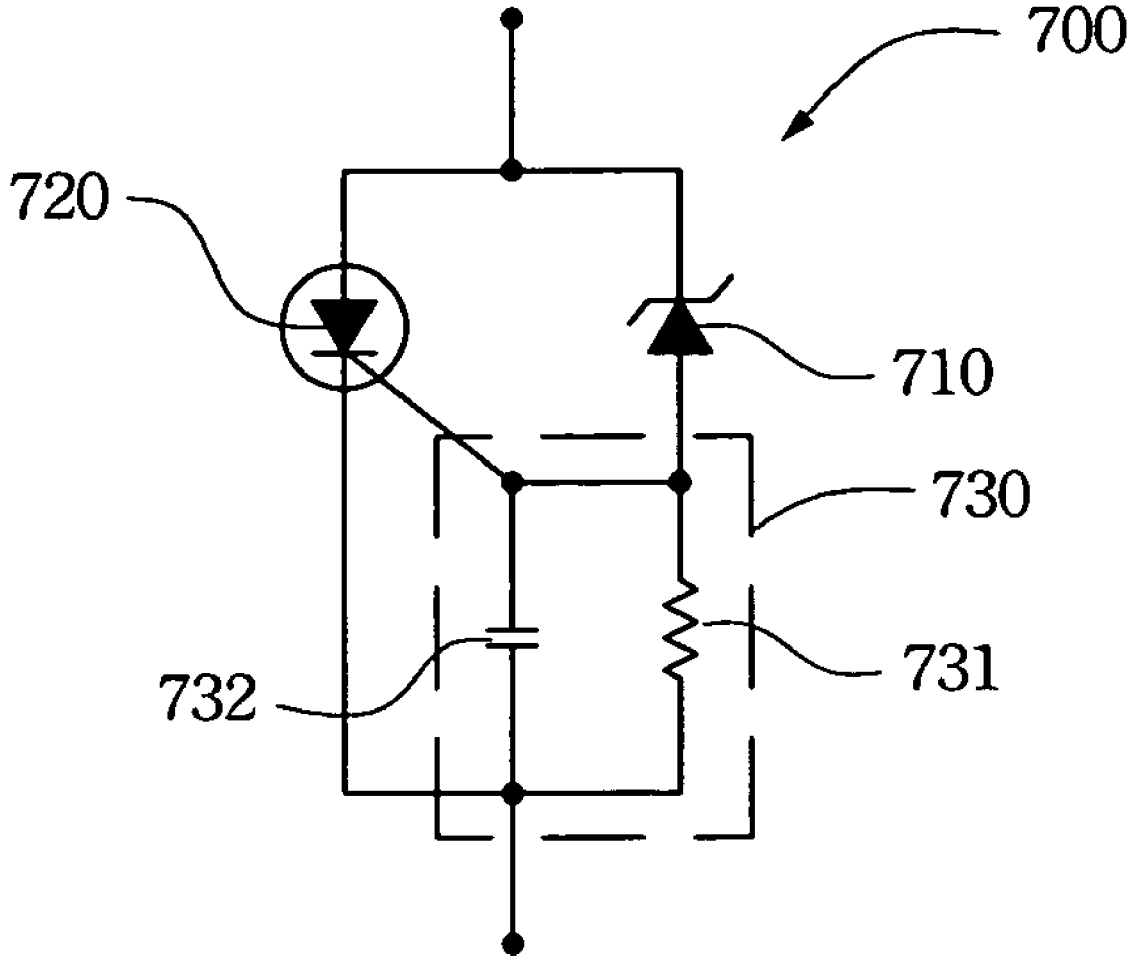
FIG. 6 depicts a circuit diagram of the short circuit according to a preferred embodiment of the present invention.

FIG. 6 depicts an embodiment of the short circuit 700, which includes a trigger part 710 and a second switch unit 720. When the LED 001 operates normally, the end voltage of the LED 001 keeps at a normally working voltage. When the LED 001 is broken to form an open circuit, the end voltage of the LED 001 is increased to be an output voltage of the power supply 200. At this time, the trigger part operates due to the raised voltage, and triggers the switch unit 720 to be at on state for replacing the broken and open-circuited LED 001, so that the power supply 200 provides unbroken LEDs 001 of the LED row 010 with current.

The aforementioned trigger part 710 is, for example, a zener diode or the like. The switch unit 720 is, for example, a transistor, or a SCR (Silicon Controlled Rectifier), TRIAC (Bidirectional Triode Thyristor) or the like thyristor in the electronic devices of the circuit industry. The short circuit 700 further includes a safety device 730 in series connection with the trigger part 710. The safety device includes a wave-filtering part 731 and a current-limiting part 732. The current-limiting part 731 connects in parallel with the wave-filtering part 732. The current-limiting part 731 is employed to limit the current passed through the trigger part 710. The wave-filtering part 732 is employed to filter a noise signal passed through the trigger part 710 for preventing a mistaken operation of the trigger part 710. The current-limiting part 731 is, for example, a resistor. The wave-filtering part 732 is for example, a capacitor.

When all LEDs 001 of the same LED row 010 are broken, the respective short circuits 700 are at on state, so that the current of the LED row 010 is abnormally higher than the predetermined working current value X. At the moment, the control part 300 cuts off the switch unit 002 of the LED row 010 to form an open circuit, for preventing the control part 300 from being destroyed by the abnormally high current. While the switch unit 002 is cutting off for forming an open circuit, the current value of the LED row 010 is zero. In order to prevent severer damage caused by the abnormal current values of other LED rows 010 that results from the control part 300 setting the current value of the open-circuited LED row 010 as the minimum $I_{min}$ to raise power supplying of the power supply 200 unlimitedly, in the meantime that the switch unit 002 cuts off for forming the open circuit, the control part 300 sends a signal to skip the detection of the current of the LED row 010 and to continue the normal operation of other LED rows 010. Alternatively, the control part 300 sends a signal to cut off power supplying of the power supply 200.

Even though the short circuit is illustrated with an embodiment of FIG. 6 in the specification, the short circuit is not limited by the circuit depicted in FIG. 6. However, any circuit, which can connect in parallel with the respective LED, connect two ends of an open circuit caused by a broken LED and make the current to pass through, should be included within the scope of the present invention.

The timing diagram of FIG. 4 shows that the reference timing pulse Tb is eight-fold of the blinking frequency TL of the LED. However, the reference timing pulse Tb is not limited by being eight-fold of the blinking frequency TL of the LED. Any reference timing pulse Tb capable of being included within the scope of the present invention, which makes the current pulses of the respective LED rows that are more than the predetermined working current value X to be in Hi condition and to be appropriate on-state timing ratios of pulses based on the reference timing pulse Th, so that the currents of the respective LED rows are balanced. The reference timing pulse Tb includes a frequency equal to or more than the blinking frequency TL of the LED.

According to the aforementioned preferred embodiments, advantages of the present invention is as follows:

1. The control part controls the current balance of the respective LED row of the light source in a thin display device anytime and continuously. That is to say, even though external factors cause changes in the currents of the respective LED rows, the control part can automatically adjust and keep the balance of the currents.
2. The switch part enables the LED to blink and turn off transiently for preventing image-sticking phenomenon on the screen.
3. The short circuits are connected in parallel with the respective LEDs. Even though any LED is broken, other LEDs can operate normally and continuously. Moreover, the control part controls the respective LED rows continuously to keep the balance of the currents.

As is understood by a person skilled in the art, the foregoing preferred embodiments of the present invention are illustrated of the present invention rather than limiting of the present invention. It is intended that various modifications and similar arrangements should be included within the spirit and scope of the appended claims, the scope of which should be accorded the broadest interpretation so as to encompass all such modifications and similar structure.

What is claimed is:

1. A control circuit for balancing current, employed in a thin display, comprising:

a light source, which includes a plurality of parallel light-emitting diode (LED) rows, wherein each of the LED rows includes:

at least one LED; and a first switch unit that is in series connection with the LED for determining whether a current passes through each of the LED rows;

a power supply that is in series connection with the light source for providing the LEDs with a working power;

a control part that detects the current of the LED rows, controls an on-state timing ratio of the first switch unit, and controls an output power of the power supply; and a short circuit connected in parallel with the LED for connecting two ends of an open circuit caused by a broken LED, wherein the short circuit comprises:

a trigger part; and a second switch unit, wherein the trigger part detects the open circuit caused by the broken LED, and then the trigger part triggers the second switch unit to be at on-state for connecting the two ends of the open circuit.

2. The control circuit for balancing current according to claim 1, wherein each of the LED rows further includes a current-limiting device being in series connection with the LED and the first switch unit for limiting the current of each of the LED rows.

3. The control circuit for balancing current according to claim 1, wherein the short circuit further comprises a safety device being in series connection with the trigger part, the safety device includes:

a wave-filtering part employed to filter a noise signal passed through the trigger part for preventing a mistaken operation of the trigger part; and a current-limiting part connecting in parallel with the wave-filtering part, wherein the current-limiting part is employed to limit the current passed through the trigger part.

4. The control circuit for balancing current according to claim 1, wherein the control part generates a reference timing pulse for controlling an on-state timing ratios of the first switch unit according to the reference timing pulse.

5. A controlling method for balancing current, employed to balance currents of a plurality of parallel LED rows in a thin display device, comprising:

increasing one of currents of the LED rows to a predetermined working current;

selecting a minimum current of the currents of the LED rows;

increasing the minimum current to the predetermined working current; and counting an on-state timing ratio of a current of each LED rows, and changing the currents of the LED rows according to the on-state timing ratio.

6. The controlling method for balancing current according to claim 5, further comprising cutting off a power supply when the current of anyone of the LED rows is detected to be zero.

7. The controlling method for balancing current according to claim 5, further comprising connecting an open circuit caused by a broken LED of the LED rows.

8. The controlling method for balancing current according to claim 5, further comprising:

making the LED rows to be opened when the current of anyone of the LED rows is detected to be increased abnormally; and skipping detection of the current of the LED rows.

9. The controlling method for balancing current according to claim 5, further comprising cutting off a power supply when one of the currents of the LED rows is detected to be increased abnormally.

* * * * *